US010624398B2

(12) United States Patent
Cho

(10) Patent No.: US 10,624,398 B2
(45) Date of Patent: Apr. 21, 2020

(54) GOLF GARMENT WITH SHOULDER JOINT SUPPORT

(71) Applicants: Kyung Ha Cho, Seoul (KR); EIGEN INNOVATION AG, Preverenges (CH)

(72) Inventor: Thomas Kyung Ha Cho, Preverenges (CH)

(73) Assignees: Kyung Ha Cho, Seoul (KR); EIGEN INNOVATION AG, Preverenges (CH)

( * ) Notice: Subject to any disclaimer, the term of this patent is extended or adjusted under 35 U.S.C. 154(b) by 37 days.

(21) Appl. No.: 15/745,476

(22) PCT Filed: Jul. 20, 2016

(86) PCT No.: PCT/KR2016/007899
§ 371 (c)(1),
(2) Date: Jan. 17, 2018

(87) PCT Pub. No.: WO2017/014554
PCT Pub. Date: Jan. 26, 2017

(65) Prior Publication Data

US 2018/0206560 A1 Jul. 26, 2018

(30) Foreign Application Priority Data

Jul. 20, 2015 (KR) ..... 10-2015-0102410

(51) Int. Cl.
*A41D 1/04* (2006.01)
*A41D 13/00* (2006.01)
(Continued)

(52) U.S. Cl.
CPC ..... *A41D 1/04* (2013.01); *A41D 13/0015* (2013.01); *A41D 13/015* (2013.01);
(Continued)

(58) Field of Classification Search
CPC ..... A63B 69/3608; A63B 69/1059; A63B 69/3641; A63B 69/3623; A63B 69/0059;
(Continued)

(56) References Cited

U.S. PATENT DOCUMENTS 2,497,843 A * 2/1950 Berle ..... A41D 27/13 2/53
2,941,210 A * 6/1960 Bren ..... A41D 27/10 2/115

(Continued)

FOREIGN PATENT DOCUMENTS

JP 08-336628 A 12/1996
JP 3054385 U * 12/1998

(Continued)

OTHER PUBLICATIONS

English language machine translation of JP 3185719 U (Pub. Aug. 2013), translation retrieved Jun. 21, 2019; https://worldwide.espacenet.com.*

(Continued)

*Primary Examiner* — Amy Vanatta
(74) *Attorney, Agent, or Firm* — LRK Patent Law Firm

(57) ABSTRACT

A golf garment for reinforcing a connection between a body and an arm has a shoulder joint support which fills a gap between the upper arm and the body at a golf posture, thereby enhancing a swing mechanism and reducing a possible injury. The shoulder joint support also mitigates the concentration of shock on the shoulder and thus the risk of injury is further reduced. Although designed specifically for golf, the present invention can be also effective for sports requiring a firm, yet tensionless connection of the arm to the body, such as tennis, hockey and baseball.

9 Claims, 4 Drawing Sheets

(51) Int. Cl.

| | |
|---|---|
| ***A63B 69/36*** | (2006.01) |
| ***A41D 27/13*** | (2006.01) |
| ***A63B 69/00*** | (2006.01) |
| ***A41D 13/015*** | (2006.01) |
| ***A41D 13/05*** | (2006.01) |

(52) U.S. Cl.
CPC ..... *A41D 13/0512* (2013.01); *A41D 27/13* (2013.01); *A63B 69/0059* (2013.01); *A63B 69/3608* (2013.01)

(58) Field of Classification Search
CPC ..... A41D 1/04; A41D 13/0015; A41D 26/10; A41D 27/13; A41D 27/10; A41D 13/0002; A41D 13/0005; A41D 2300/20; A41D 2600/10; A41D 13/015; A41D 13/0512
USPC ..... 2/125
See application file for complete search history.

(56) References Cited

U.S. PATENT DOCUMENTS

| | | | | | |
|---|---|---|---|---|---|
| 3,013,276 | A * | 12/1961 | Maxwell | A41D 27/10 | 2/115 |
| 3,106,718 | A * | 10/1963 | Raab | A41D 13/08 | 128/881 |
| 4,058,852 | A * | 11/1977 | Aragona | A41B 1/00 | 2/115 |
| 7,585,229 | B2 * | 9/2009 | Kelley | A63B 69/3608 | 473/212 |
| 7,985,144 | B1 * | 7/2011 | Gonzales | A41D 13/0015 | 2/93 |
| 2005/0049068 | A1 * | 3/2005 | Chang | A63B 69/0059 | 473/276 |
| 2005/0153817 | A1 * | 7/2005 | Fogarty | A63B 69/0059 | 482/51 |
| 2005/0288121 | A1 * | 12/2005 | Roberts | A63B 69/3608 | 473/276 |
| 2006/0150298 | A1 * | 7/2006 | Jones | A41D 3/00 | 2/93 |
| 2009/0025115 | A1 * | 1/2009 | Duffy | A41D 13/0015 | 2/69 |
| 2011/0277208 | A1 * | 11/2011 | Wortman | A41D 13/0015 | 2/69 |
| 2012/0184388 | A1 * | 7/2012 | Clark | A63B 69/3608 | 473/276 |
| 2016/0243424 | A1 * | 8/2016 | Vilhelmsen | A63B 69/0059 | |

FOREIGN PATENT DOCUMENTS

| | | | |
|---|---|---|---|
| JP | 3185719 | U | 8/2013 |
| KR | 10-0605570 | B1 | 7/2006 |
| KR | 10-2009-0085461 | A | 8/2009 |
| KR | 20-2015-0002384 | U | 6/2015 |

OTHER PUBLICATIONS

Search Report, dated Oct. 26, 2016, for International Application No. PCT/KR2016/007899.
Nritten Opinion, dated Oct. 26, 2016, for International Application No. PCT/KR2016/007899.

* cited by examiner

GOLF GARMENT WITH SHOULDER JOINT SUPPORT

CROSS-REFERENCE TO RELATED APPLICATIONS

The present application is a U.S. National Phase entry from International Application No. PCT/KR2016/007899, filed Jul. 20, 2016, which claims priority to Korean Patent Application No. 10-2015-0102410, filed Jul. 20, 2015, the disclosure of which is incorporated by reference herein in its entirety.

BACKGROUND OF THE INVENTION

1. Technical Field

The present invention relates to a golf garment for enhancing the connection between the body and the arm; their proper connection not only renders a golf swing more efficient but also reduces the occurrence of injury. By wearing the present garment repeatedly, the user will gradually learn how to connect the atm to the body properly. The present garment also mitigates the concentration of the load on some specific parts of the body. Therefore, the present invention is on the crossroads of a swing trainer and an injury prevention device.

2. Description of Related Art

During a golf swing, the power, mainly generated by the body rotation, is transmitted to the arms, which also generate some complementary power. For an efficient power transmission and synchronization, it is essential to maintain a good relationship between the body and the arms through the entire swing.

A number of swing trainers has been invented in this regard; some of them proved to be effective. However, they are often complex or odd-looking. Moreover, they are mostly designed for use at the practice range only, it is not always easy to bring the lessons learned at the practice to the course. Therefore, there is a need for an effective swing trainer that is simple to use, ordinary-looking and that can be used both on the practice range and on the course.

SUMMARY OF THE INVENTION

Golf injuries are mainly due to a poor swing mechanism. Even advanced golfers may suffer from injuries due to intensive training and playing. Therefore, there is a need for a device that reduces the risk of injury by enhancing the swing mechanism and by mitigating the concentration of the load on some specific parts of the body, such as elbow and shoulder.

The objective of the present invention is to provide a golf garment with two distinct, yet related purposes: as a swing trainer and as an injury prevention device.

The present invention relates to a garment for the upper part of the body equipped with a special shoulder joint support placed under the shoulder joint portion of the garment. This shoulder joint support enlarges the connection area between the body and the arm, and thus reinforces their connection through the golf swing.

Advantageous Effects

This helps to maintain a solid, yet tensionless connection between the body and the arms which enhances the swing mechanism and thus reduces the risk of injury. Moreover, the shoulder joint support mitigates the concentration of the load/shock on the shoulder, and the risk of injury is thither reduced.

The present invention can be worn by golfers of all ages and of all skill levels. In particular, as an injury prevention device, the present garment would be extremely useful for senior golfers, as the joints become more vulnerable with age.

DETAILED DESCRIPTION OF THE INVENTION

The present invention relates to a golf wear having a shoulder joint supporter. Provided in the present invention is a clothing good, comprising: at least one shoulder joint supporter which is appropriate to be worn under a shoulder joint when playing golf, and a clothing structure for covering at least a shoulder joint portion of a body, wherein the clothing structure is configured to be tight on the shoulder joint portion, the shoulder joint portion of the clothing structure being configured to receive at least one shoulder joint supporter, wherein the shoulder joint supporter, when wearing the clothing good, is arranged under the shoulder joint portion of the clothing structure so that the shoulder joint supporter is compressed between the upper arms and the torso when in a golf position.

In the following, the details are set to provide a better understanding of the present invention. The illustrations are for explanatory purposes and should not be construed as limiting the scope of the present invention.

Figure 1:
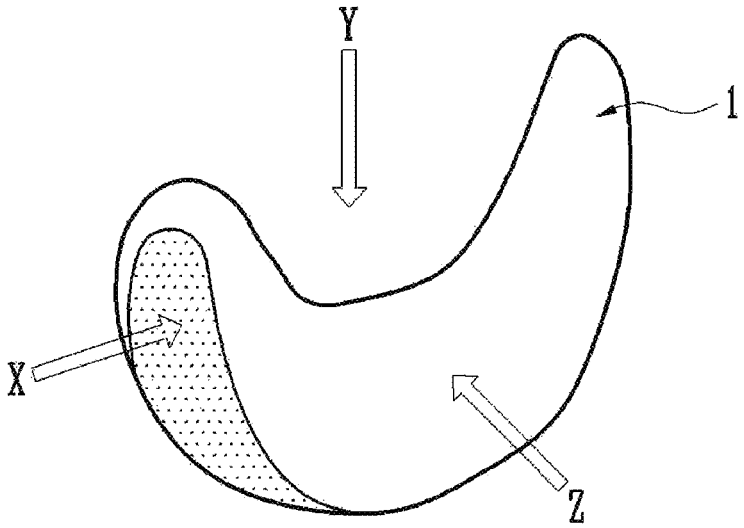
FIGS. 1-4 illustrate a shoulder joint support from various viewpoints.
Figure 2:
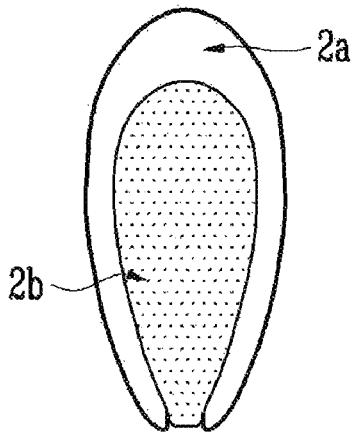
Figure 3:
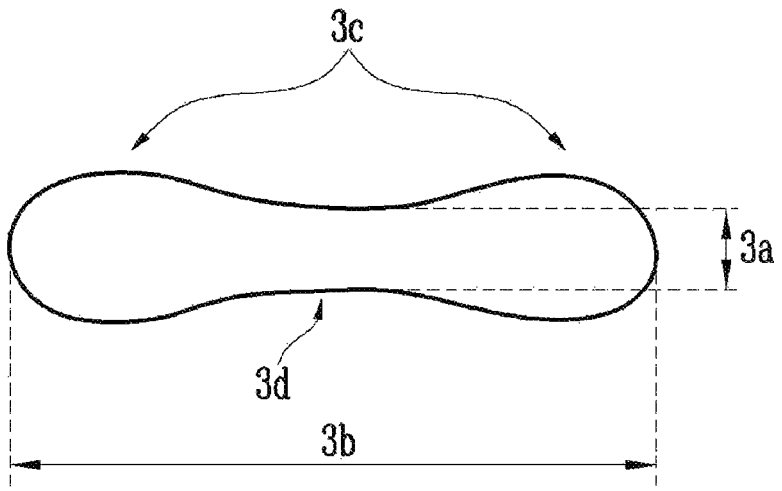
Figure 4:
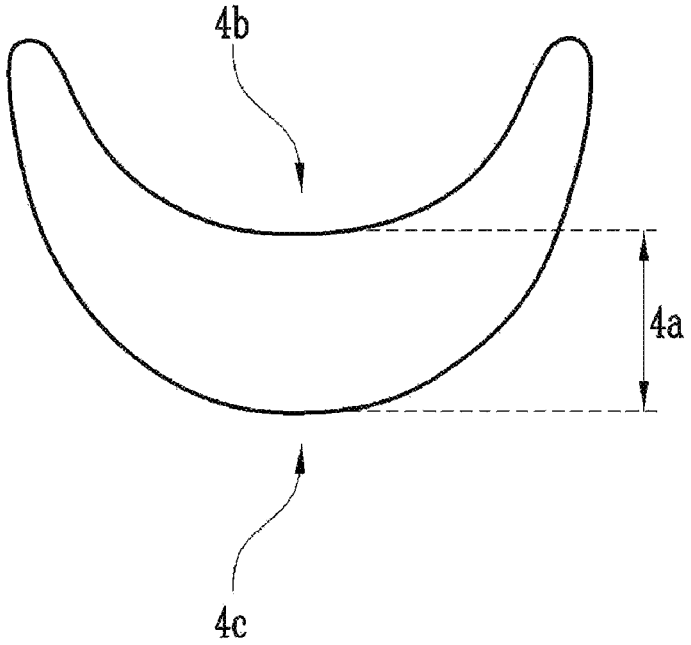

FIGS. 1-4 illustrate a possible design for a shoulder joint support 1. FIG. 1 provides a perspective view, FIG. 2 provides a front view along axis X of FIG. 1, FIG. 3 provides atop view along axis Y of FIG. 1 and FIG. 4 is a side view along axis Z of FIG. 1.

When a golfer wears the shoulder joint support, the shoulder joint support is compressed between the upper arm and the body, the shoulder joint support helps to unify the movement of the arms and the body so that they move in unison when the user takes a golf swing; this promotes a good golf swing technique and reduces the occurrence of injury.

The design of the shoulder joint support illustrated in FIGS. 1-4 favors an ergonomic fit between the upper arm and the body. As illustrated in FIG. 4, the shoulder joint support is crescent-shaped; the shoulder joint support has a concave upper surface 4*b* for improved fit under the shoulder joint. It should be understood that the shoulder joint support may be of any suitable profile: it may also be trapezoidal, ovoid, U-shaped, or any variation of those.

FIG. 3 provides a top view of the shoulder joint support, where it can be seen that, preferably, each of the end portions 3*c* is thicker than the middle portion 3*d*, for an increased unity of the arm and the body.

The shoulder joint support may be of any suitable size, depending in particular on the size of the garment. Typically, the shoulder joint support can have a length 3*b* of between 15 and 25 cm, a width 4*a* of between 2 cm and 7 cm and a thickness 3*a*, measured at the middle portion 3*d*, of up to 4 The shoulder joint support can have an adjustable thickness; for example, an inflatable shoulder joint support.

The shoulder joint support is made of soft and light, yet supportive materials having characteristics such as anti-bacterial, breathing, fast-dry and durable. For example the shoulder joint support may be made of polyamide, polystyrene, polyurethane, silicon, cotton, and/or any combination of those materials. The average density of a shoulder joint support can be up to 100 kg per cubic meter, which ensures that the shoulder joint support is lightweight enough, while providing desired supportiveness.

As illustrated in FIGS. 1 and 2, the shoulder joint support may comprise an outer shell part 2*a* and an inner part 2*b*. The outer shell part and the inner part may or may not be made of the same material.

The shoulder joint support is to fill the gap that exists between the body and the upper arm when the wearer takes a golf posture. In implementing the shoulder joint support on a garment, in order for the shoulder joint support to be effective, the shoulder portion of the garment must be a tight fit.

Figure 5:
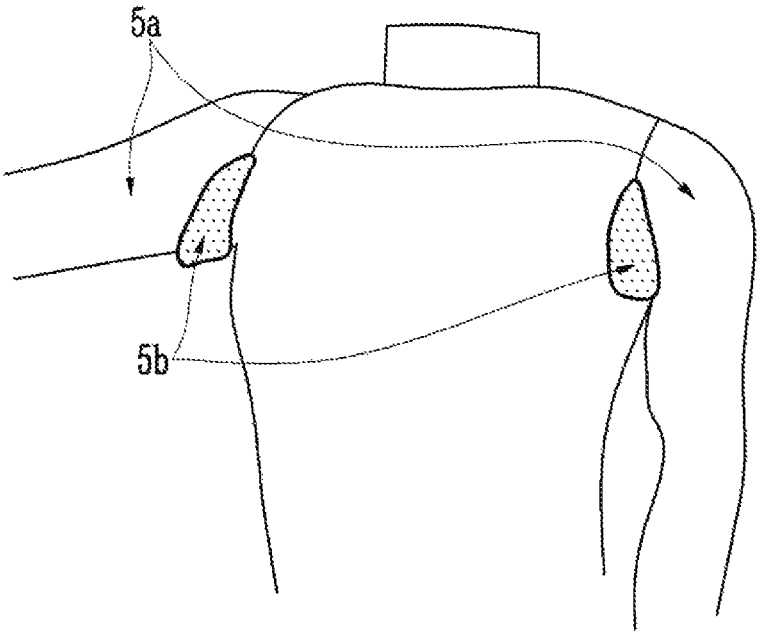
FIG. 5 illustrates a tight fit undershirt, showing a shoulder joint support placed on each sleeve.

FIG. 5 provides a front view of a tight fit garment having the shoulder joint support 5*b* placed on the upper part of the sleeves 5*a* so that they are located under the shoulder joints of the user at the golf posture. The choice of the sleeve as opposed to the body portion of the garment is for comfort, versatility and aesthetical considerations.

Figure 6:
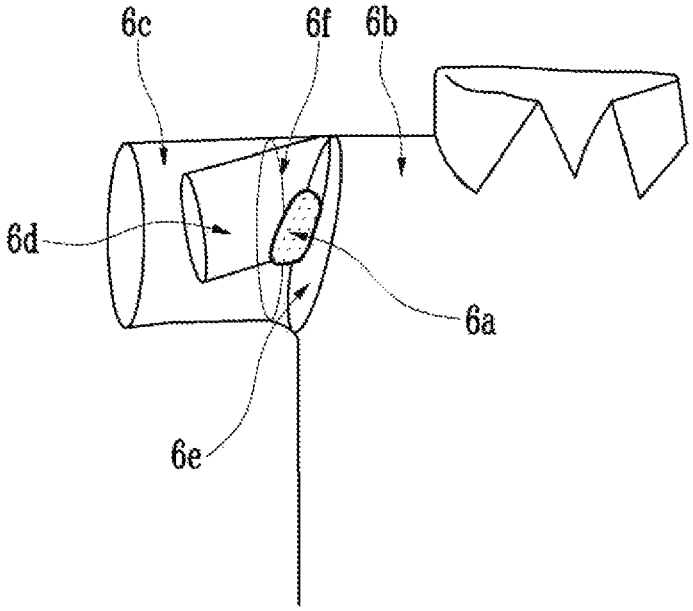
FIG. 6 illustrates a loose-fit shirt with an inner sleeve; the inner sleeve is a tight fit and a shoulder joint support is placed on the inner sleeve.
Figure 7:
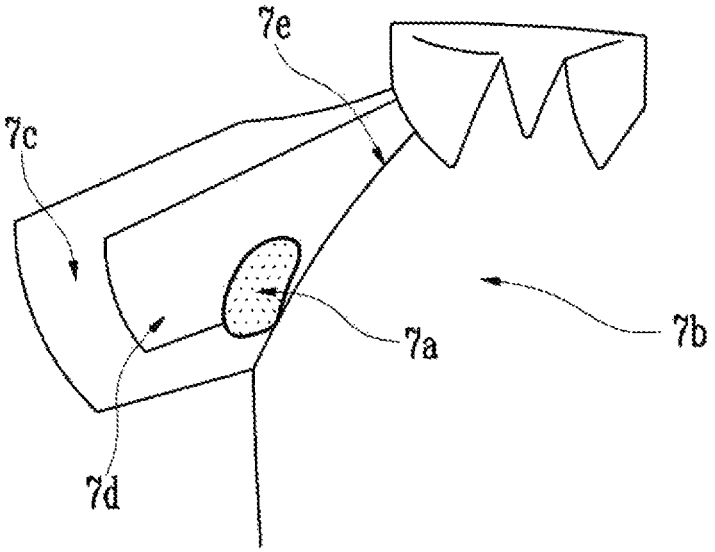
FIG. 7 illustrates a raglan-style shirt with an inner sleeve, showing the placement of a shoulder joint support on the inner sleeve.

FIGS. 6 and 7 illustrate examples of a loose fit garment according to further embodiments of the present invention. As the shoulder joint support is not effective on a loose fit garment, an inner garment is added: the shoulder joint portion of the inner garment, where the shoulder joint support 6*a*, 7*a* is placed, is designed so as to provide a close fit to the shoulder joint. In FIG. 6, the inner garment comprises an inner sleeve 6*d* and an inner torso portion 6*e*; the inner torso portion is sewn on the torso portion 6*b* of the garment in the vicinity of the junction 6*f* of the sleeve 6*c* and the torso portion 6*b* of the garment. FIG. 7 illustrates a raglan-style garment, where the inner garment comprises an inner sleeve 7*d* extending to the torso portion 7*b* of the garment, sewn on the junction 7*e* of the sleeve 7*c* and the torso portion 7*b* of the garment.

The shoulder joint support may be removable (for instance by hooks and loops bands, buttons, pockets) or may be an integral part of the garment. The shoulder joint support and its placement should be designed under the full consideration of functionality, comfort and aesthetical aspects. In particular, the presence of the shoulder joint support should not be noticeable from outside and should not impede any free movement, so that the garment can be worn at any time.

INDUSTRIAL AVAILABILITY

The present invention can be used in golf functional apparel.

The invention claimed is:

1. An article of apparel comprising:

one or more shoulder joint supports configured to be worn in close fit with armpits below shoulder joint of a human body; and a garment structure for covering at least a shoulder joint portion of the human body, wherein the garment structure is configured so as to provide a close fit to at least the shoulder joint portion of the human body, wherein a shoulder joint portion of the garment structure is arranged so as to receive the one or more shoulder joint supports in a portion corresponding to an underside of the shoulder joint portion of the human body, wherein the garment structure comprises an outer garment of a structure configured to provide a loose fit to the human body, and an inner garment of a structure configured to provide a close fit to the human body, wherein the inner garment is coupled to the outer garment and designed so as to provide a close fit to the shoulder joint of the human body, wherein the inner garment comprises an inner sleeve and an inner torso portion, and the outer garment comprises an outer sleeve and an outer torso portion, wherein the shoulder joint support is coupled to the shoulder joint portion of the inner sleeve and the inner torso portion of the inner garment, and wherein the shoulder joint support has a structure in which when a user wears the article of apparel and takes a golf posture, the shoulder joint support is configured to fit closely into the armpits of the user and the shoulder joint support is in configured to be close fit with the user's upper arm and torso.

2. The article of apparel according to claim 1, wherein the garment structure receives the shoulder joint support for one or both shoulders.

3. The article of apparel according to claim 1, wherein:

the shoulder joint support, when viewed in a cross section in a width direction, has an elliptical shape of a predetermined length, and includes an inner part and an outer shell surrounding the inner part, and a width of a middle portion of the elliptical shape is larger than a width of each of upper and lower portions of the elliptical shape;

when viewed from the top, a middle portion of the shoulder joint support has a narrow width with respect to one or both ends of the shoulder joint support, and the both ends have a curved shape;

the shoulder joint support is crescent-shaped, and comprises an upper surface having a concave profile so that the shoulder joint support is ergonomically shaped to fit under the shoulder joint of the user, and a lower surface having a convex profile; and a middle portion between the concave profile and the convex profile has a predetermined thickness and has a shape that becomes narrower from the middle portion to both ends.

4. The article of apparel according to claim 1, wherein the inner torso portion of the inner garment is sewn on the outer torso portion of the outer garment in the vicinity of a junction of the outer sleeve and the outer torso portion of the outer garment.

5. The article of apparel according to claim 1, wherein the shoulder joint support is configured to have a thickness, measured at a middle portion, of up to 4 cm, a length between 15 cm and 25 cm and a width between 2 cm and 7 cm.

6. The article of apparel according to claim 1, wherein the shoulder joint support is configured to have a density of up to 100 kg per cubic meter.

7. The article of apparel according to claim 1, wherein the shoulder joint support is configured to have an adjustable thickness.

8. The article of apparel according to claim 1, wherein the shoulder joint support is integral to the inner garment.

9. The article of apparel according to claim 1, wherein the shoulder joint support is removable.

* * * * *